US006752367B2

(12) United States Patent
Yamashita et al.

(10) Patent No.: US 6,752,367 B2
(45) Date of Patent: Jun. 22, 2004

(54) BANKNOTE HANDLING DEVICE

(75) Inventors: Taichiro Yamashita, Tsuchiura (JP); Kazushi Yoshida, Chiyoda (JP); Riichi Katou, Nagoya (JP)

(73) Assignee: Hitachi, Ltd., Tokyo (JP)

( * ) Notice: Subject to any disclaimer, the term of this patent is extended or adjusted under 35 U.S.C. 154(b) by 3 days.

(21) Appl. No.: 10/307,436

(22) Filed: Dec. 2, 2002

(65) Prior Publication Data

US 2003/0193273 A1 Oct. 16, 2003

(30) Foreign Application Priority Data

Apr. 10, 2002 (JP) ..... 2002-107272

(51) Int. Cl.[7] ..... A47B 8/00
(52) U.S. Cl. ..... 248/312
(58) Field of Search ..... 312/100, 102, 312/223.1

(56) References Cited

U.S. PATENT DOCUMENTS

2002/0063498 A1 * 5/2002 Blake et al. ..... 312/100

* cited by examiner

*Primary Examiner*—Ramon O Ramirez
(74) *Attorney, Agent, or Firm*—Antonelli, Terry, Stout & Kraus, LLP

(57) ABSTRACT

A banknote handling device embedded in an outer wall, in which a shutter for a deposit/withdrawal port is stably operated even in a rainy weather condition, including a door having an outer surface exposed outdoors, for covering a deposit/withdrawal port, incorporates a rain water draining means for draining rain water falling onto the outer surface of the door, outside of the device. The rain water draining means comprises an inclined surface incorporated in the outer surface of the door, a water channel through which rain water dripping from the outer surface of the door flows, and a drain pipe for receiving rain water flowing from the water channel, and draining the rain water outside of the device.

10 Claims, 9 Drawing Sheets

BANKNOTE HANDLING DEVICE

BACKGROUND OF THE INVENTION

The present invention relates to a banknote handling device having a cash deposit/withdrawal port which is exposed to the outdoor.

Among automatic teller machines (which will be hereinbelow abbreviated to "ATM"), the one which is embedded in a wall of a building, having a manipulation panel (front face) alone exposed to the outside of the wall of the building but the remainder portions (of the body housing) located inside of the wall in view of security.

Usually, the housing body of an ATM embedded in a wall, is substantially parallelepiped, having a manipulation panel which is laid substantially in parallel with a vertical surface of the housing body.

JP-A-11-232527 discloses an ATM which is embedded in a wall having a thickness of 13 inches, greater than a usual wall thickness which is 6 inches, and which incorporates a transfer unit having a length of 7 inches corresponding to a value by which the wall thickness is greater than the usual wall thickness, and adapted to transfer banknotes from the manipulation panel to a process portion for banknotes.

JP-A-6-282724 discloses an ATM having a cash deposit/withdrawal port in such a configuration that a door (which will be hereinbelow referred to as "shutter") is laid in a vertical plane, for shielding the deposit/withdrawal port from rain water which runs down the shutter, which is then trapped in a rail portion in the lower part of the shutter, and which is finally drained outside through a drain port formed in the rail portion.

Meanwhile, JP-A-2000-172946 discloses an ATM having a banknote storage portion for depositing or withdrawing cash, in which banknotes are accommodated in an upright posture, and accordingly, the user can carry out both deposit and withdrawal of cash. This ATM has been widely used, being in general located outdoor.

In a deposit transaction portion for cash or a withdrawal transaction portion, banknotes which are cash to be transacted are led out one by one for transaction after they are charged by the user through the deposit/withdrawal port in a deposit transaction portion.

JP-A-2000-99795 discloses such a configuration in which a storage portion for dispensing banknotes to a user is arranged in a substantially upright posture.

BRIEF SUMMARY OF THE INVENTION

An object of the present invention is to provide a banknote handling apparatus embedded in an outer wall of a building, in which a shutter for a deposit/withdrawal port can be stably operated in a rainy weather atmosphere.

In the case of the ATM embedded in a wall as disclosed in the above-mentioned JP-A-11-232527, since the front face part is substantially vertical, banknotes are discharged, substantially perpendicular to the front face part, that is, substantially horizontal as viewed by the user when the user withdraw cash. Meanwhile, upon withdrawal of cash, one or a plurality of banknotes which are discharged, substantially horizontal, are pinched with the fingers of the user, and pulled out toward the user. Thus, the user can obtain cash on hand. This procedure is carried out in general.

In such a configuration, as to the size of an opening for withdrawal of cash, it has a thickness which is greater than the thickness of a maximum number of banknotes, for example, about fifty banknotes by an extra thickness so that the banknotes is prevented from being caught at their ends, that is, it is a slit having a thickness of, for example, about 10 mm. Banknotes whose front end is projected from the opening by, for example, about 30 mm can be simply pinched and pulled out with the fingers of the user.

By the way, with the opening which is opened so that banknotes are discharged, substantially horizontal as viewed by the user, since the size of the opening is small, the interior of the ATM is not substantially affected by the ambient temperature, and since the opening is substantially vertical, rain water is not accumulated in the opening even in a rainy weather condition, and further, rain water scarcely enters the inside of the ATM through the opening.

With this configuration in which the shutter is laid in a vertical plane, no seal member is used in the deposit/withdrawal port, as disclosed in JP-A-6-282724, and rain water falling on to the shutter is trapped in a rail portion in the lower part of the shutter which is then drained outside through a drain port formed in the rail portion.

However, there has been possibly caused a problem in the case of insertion of banknotes into a port which is horizontally opened.

For example, when a banknote which is inelastic, or a banknote which is prone to fold or bend is inserted into the port, the leading end part of the banknote or the part thereof, which is prone to fold or bend droops, and accordingly, it is likely to be caught to the opening of the port. In particular, if a bundle of several banknotes which are horizontally aligned, are to be inserted into the opening of the port in order to deposit then at one time, the insertion thereof can hardly be made by one hand of the use, and accordingly, the user uses his both hands for the deposit so as to cause inconvenience.

Meanwhile, as disclosed in JP-A-2000-172946, there has been, in general, widespreadly used an ATM which is configured such that a storage portion for deposit and withdrawal of banknotes, can store therein banknotes in an upright posture, and which can be installed outdoor, thereby the user has conventionally been able to carry out both deposit and withdrawal of banknotes.

In the ATM having the above-mentioned configuration, the shutter (that is, a deposit/withdrawal door) for the deposit/withdrawal port is extended substantially horizontally, or is slightly inclined downward forward. The shutter is slid, for example, in the inward direction, so as to be opened. In order to readily insert banknotes, the dimensions of the shutter are more or less grater than that of banknotes. For example, it has a length of about 100 mm and a width of about 200 mm. The shutter is slid, for example, in the inward direction in order to open the shutter.

However, with the deposit/withdrawal port having such a configuration that the shutter is laid horizontally or inclined, and applied to an outdoor installation type ATM in an environment in which it is exposed to the ambient air, rain water falls onto the shutter in, for example, a rainy weather condition. Accordingly, it is required to continuously drain rain water in order to avoid accumulation of rain water by a large quantity on the shutter. A required quantity of rain water to be drained is determined so as to drain rain water in a rainy weather condition with an expected maximum rain fall. Should rain water comes into the ATM, the interior of the ATM becomes wet, and accordingly, a roller or the like would become wet so as to change its frictional coefficient from that in its dry condition. As a result, a banknote transfer function could not be ensured or components made of iron would rust. Thus, it has to prevent rain water from coming into the ATM.

As stated above, the deposit/withdrawal door (shutter) of the ATM embedded in an outer wall, through which banknotes can be inserted or discharged, requires to drain water falling on the door.

Next, explanation will be made of the configuration and operation of a cash deposit/withdrawal transaction portion which is located inside (underside) of the deposit/withdrawal port, for receiving banknotes for deposit and discharging banknotes for withdrawal. The deposit/withdrawal transaction portion is composed of a storage part which can receive banknotes to be deposited and accumulate banknotes to be withdrawn, a separation mechanism for carrying out deposit transaction by separating banknotes received in the storage part, from one another, and a stack mechanism for arranging in order and accumulating banknotes to be discharged during withdrawal transaction.

In the cash deposit/withdrawal transaction portion, cash to be deposited is transacted such that banknotes are paid out one by one for transaction after they are inserted by the user into the deposit/withdrawal port which is the deposit transaction part. In such a configuration, the storage part for discharging banknotes to the user is arranged in a substantially upright posture, as disclosed in JP-A-2000-99795. Thus, banknotes are received in an upright posture when the banknotes are inserted by the user, and accordingly, even though the banknotes are inserted without being arranged in order, the banknotes can be arranged in order at their lower ends with the use of the gravity. Thus, the separation mechanism can appropriately pay out the banknotes out one by one. Further, since the banknotes are held in an upright posture, a load exerted to the separation mechanism is constant, irrespective of a number of inserted banknotes, when the banknotes are separated from one by one, and accordingly, such double feed that two banknotes overlap with each other can be avoided during the separation, thereby it is possible to enhance the reliability.

Meanwhile, when banknotes are delivered to the user, if the banknotes are accumulated in an upright posture by the stack mechanism, the banknotes are arranged in order at their lower end, preferably for the user who receives the bank notes even though the sizes of the banknotes are different from one another in depending upon a kind of money as those in Asian countries, European countries or the like.

If banknotes having different sizes are mingled together, since the banknote storage part has a size which is grater than a maximum size of banknotes, positions of banknotes having a minimum size which are charged into the storage part, are uneven within the width and height of the storage part. However, if the storage part is in an upright posture, banknotes can be arranged in order at their lower ends under the gravity, and accordingly, the banknotes can be separated one by one at their lower ends by the separation mechanism for deposit transaction, regardless of their sizes.

Thus, in the case of the ATM embedded in a wall, it is desirable to hold banknotes arranged in order at their lower ends in the deposit/withdrawal portion. However, in this configuration, the shutter, that is, the door for the deposit/withdrawal port would be laid over the upper surface of the deposit/withdrawal port.

In the ATM having the above-mentioned configuration, the shutter for the deposit/withdrawal port is laid, substantially horizontal, or is inclined downward in one direction. For example, the shutter is slid inward for opening. However, since the shutter is horizontal or inclined, it is required to continuously drain rain water so as to avoid pooling of rain water by a large quantity on the shutter onto which rain falls in, for example, a rainy weather condition, in order to prevent the rain water from coming into the ATM.

Thus, the inventors have created such a configuration that rain water pooling on the shutter is drained outside of the ATM.

In order to achieve the above-mentioned objects, according to the present invention, there is provided a banknote handling device embedded in an outer wall, which can stably operates a door as a shutter for covering a deposit/withdrawal port for banknotes even in a rainy weather environment, comprising a rain water draining means for draining rain water falling on an upper surface of the door, which is exposed outdoors, the rain water draining means incorporating an inclined surface formed on the upper surface of the door, a water channel for guiding rain water dripped from the upper surface, and a water pipe for receiving rain water from the water channel and draining the rain water outside of the device.

Further, in order to achieve the above-mentioned object, according to the present invention, there is provided a banknote handling device including a door having a surface exposed outdoors, for opening and closing a deposit/withdrawal port for banknotes, the door being inclined downward forward, left and right sub-water channels laid in substantially parallel with left and right edges of the door and inclined downward forward, for receiving rain water dripped from the left and right edges, a main water channel laid in substantially in parallel with a leading end of the door and having left and right side ends at least one of which is connected to a drain pipe, for receiving rain water dripping from the leading edge and also receiving rain water flowing from the left and right sub-channels, the main water channel being inclined so that the one side end which is connected to the drain pipe is lower than the other.

Moreover, in order to achieve the above-mentioned object, according to the present invention, there is provided a banknote handling device including a door for opening and closing a deposit/withdrawal port for banknotes, the door having a surface opposed outdoors, the door being laid, substantially horizontal, but being inclined downward forward, comprising left and right sub-channels laid in substantially parallel with left and right edges of the door, for receiving rain waters dripping from the left and right edges of the door and allowing the rain waters to flow forward, and a main channel laid in substantially parallel with a leading end of the door and having left and right side ends at least one of which is connected to a drain pipe, but inclined so that the side end which is connected to the drain pipe is lower than the other side end, for receiving rain water dripping from the leading end, and also receiving rain water flowing from the left and right sub-channel.

Other objects, features and advantages of the invention will become apparent from the following description of the embodiments of the invention taken in conjunction with the accompanying drawings.

DETAILED DESCRIPTION OF THE INVENTION

Explanation will be hereinbelow made of an embodiment of an ATM incorporating a banknote handling device according to the present invention with reference to FIGS. 1 and 3.

Figure 1:
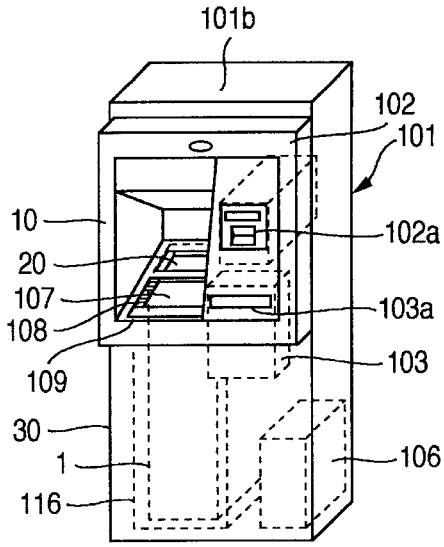
FIG. 1 is a perspective view illustrating an external appearance of an embodiment of an ATM incorporating a banknote handling device according to the present invention.
Figure 3:
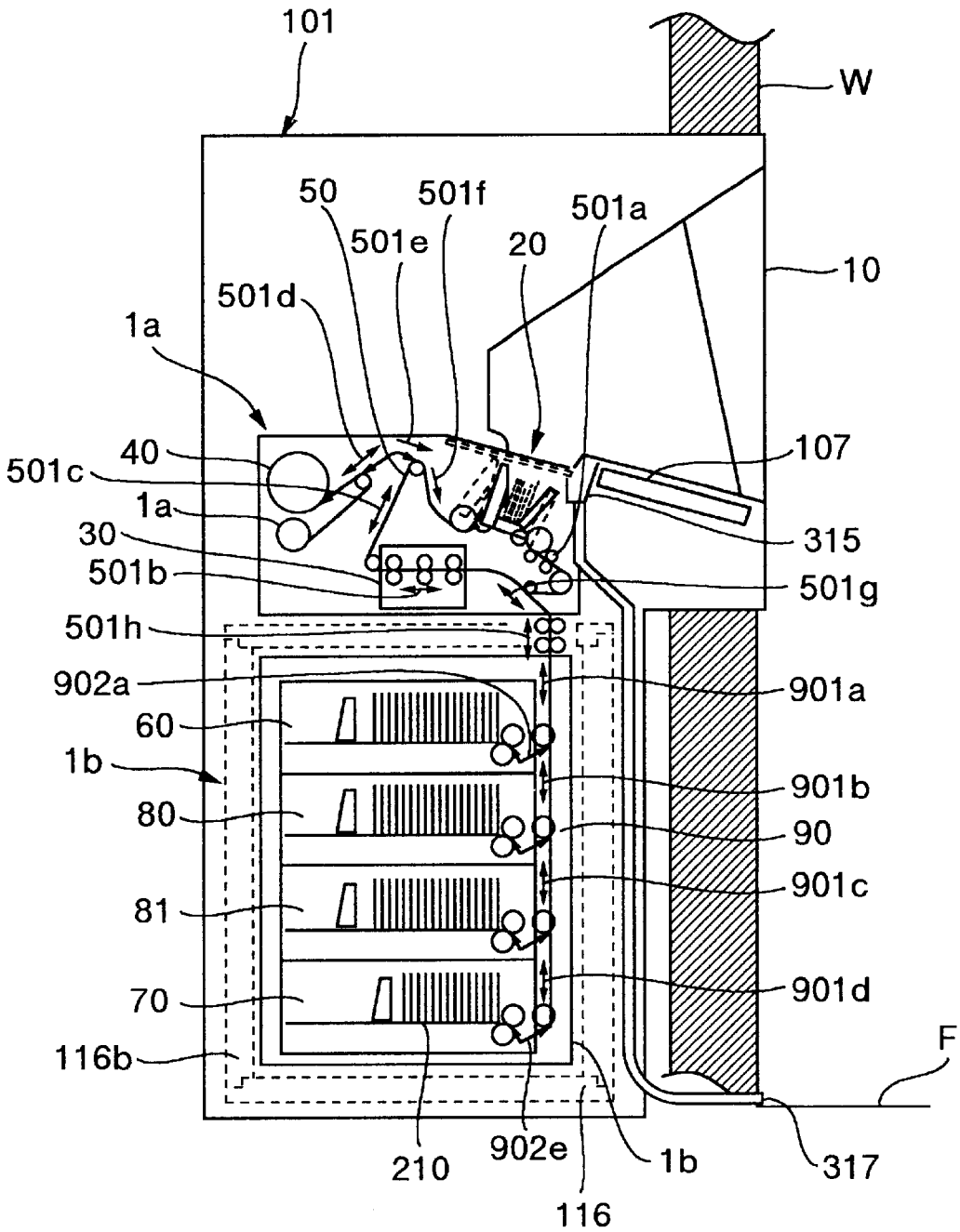
FIG. 3 is a sectional view illustrating the embodiment of the ATM according to the present invention.

FIG. 1 is a perspective view illustrating an external appearance of an ATM embedded in a wall and applied thereto with the present invention, and FIG. 3 is a sectional view illustrating the ATM in a condition in which it is embedded in an wall.

The configuration shown in FIG. 3 will be later explained in detail.

Referring to FIGS. 1 and 3, the ATM 101 has a body housing 30 whose front face part 10 which is a user manipulation panel is laid in a substantially upright posture, being projected from the body housing 30. That is, the front face part 10 is fitted in an aperture opened in a wall surface W of a building.

The user of the ATM can be carried out handling of several kinds of cash, such as deposit and withdrawal of cash while he stands in front of the ATM. The degree of the projection of this front face part is substantially equal to the thickness of the outer wall of the building, that is, about 5 inches. The front face part 10 incorporates therein a card/slip processing mechanism 102 communicated with a card slot 102*a*, for processing a user's card and printing data on an itemized transaction slip which is then discharged thereby, and a banknote processing mechanism 103 communicated with a banknote slot 103*a*, for processing a user's banknote and printing a content of transaction on the banknote which is then discharged thereby.

A deposit/withdrawal port 20 through which the user takes banknotes into or out, is formed in a surface which is extended inward from an opening in the front face part of the body housing 30 and which is substantially horizontal or which is inclined so as to be lower on the front face 10 side, and is provided with a shutter for opening and closing the port 20. Further, a display means 107 exhibiting a content of transaction and a client manipulation means 108 for inputting the content are provided on this surface.

A banknote storage portion in the lower part of the banknote deposit/withdrawal device 1 is surrounded by a safe housing 116 made of thick steel panels having a thickness of about 10 mm so as to have a relatively robust housing structure, different from the body housing 102 which also has a robust housing structure. Thereby it is possible to enhance the security. This ATM can carry out transaction such as deposit and money transfer by the user or payment for the user through the intermediary of a card, banknotes, a slip or a bankbook.

Figure 2:
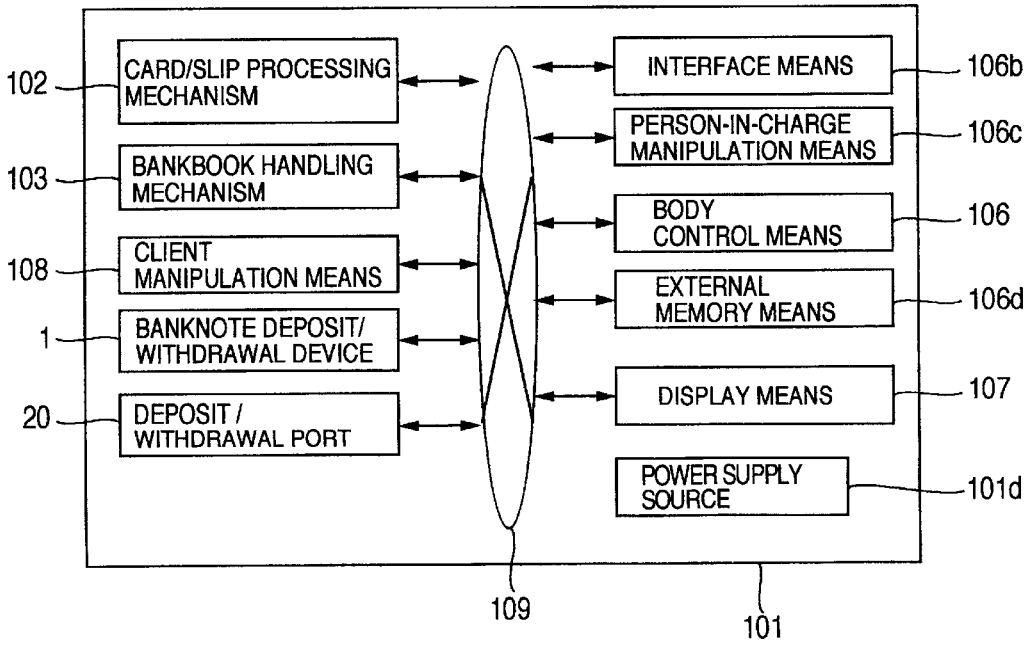
FIG. 2 is a block diagram illustrating a control configuration of the ATM in the embodiment of the present invention.

Referring to FIG. 2 which is a control block diagram for explaining a control relationship of this device, the card/slip processing mechanism 102, the bankbook processing mechanism 103, and the banknote deposit/withdrawal device 1, the client manipulation means 108, the deposit/withdrawal port 20 and the display means 107 which are all incorporated in the ATM 10 are connected to a body control means 106 through the intermediary of a bus 109, and carry out required operation under the control of the body control means 106 which is connected, in addition to the above-mentioned components, to an interface means 106, a person-in-charge manipulation means 106*c* and an external memory means 106*d* through the intermediary of the bus 109 so as to transfer required data among them, but these components are not essential in the present invention, and accordingly, detailed description thereto will be omitted.

It is noted that the above-mentioned means, parts and components are supplied thereto with an electric power from a power source portion 101*d* shown in FIG. 2.

Referring to FIG. 3 which is a sectional view illustrating the configuration of the ATM according to the invention, shown in FIG. 1, the banknotes deposit/withdrawal device 1 incorporates the deposit/withdrawal port 20 through which the user takes banknotes into and out, a banknote checking portion 30 for checking banknotes, and a temporary storage 40 for once holding deposited banknotes until the transaction thereof is completed. The banknotes are accommodated in a deposit storage 60 after the deposit transaction thereof is completed. Banknotes to be withdrawn are accommodated in a deposit storage 70, and a recycle storage 80 is used for banknotes to be deposited or withdrawn. Further, the recycle storage 80 is replenished with banknotes from a charge/restore storage 81 in which banknotes returned from the recycle storage 80 are accommodated. A banknote transfer path 50 is routed through the banknote checking portion 30 in order to transfer banknotes to the deposit/withdrawal port 20, the temporary storage 40, the deposit storage 60, the withdrawal storage 70, the recycle storage 80 or the charge/restore storage 81. A control portion which is although not shown is, of course, incorporated.

Figure 4:
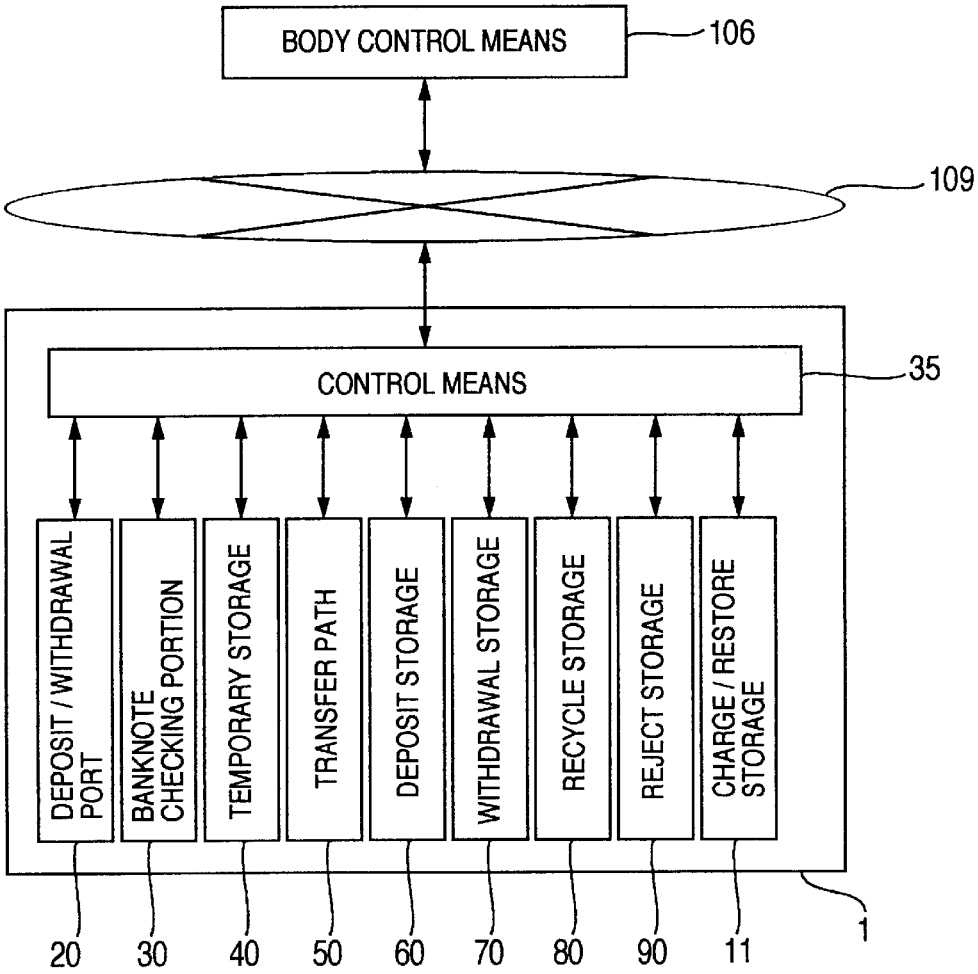
FIG. 4 is a block diagram illustrating a control configuration of the banknote handling device in the ATM according to the present invention.

Referring to FIG. 4 which is a block diagram for explaining the control relationship of the banknote handling devices the control means 35 which is connected to the body control means 106 through the intermediary of the bus 109, controls the banknote deposit/withdrawal device 1 in response to instructions from the body control means 106 and in accordance with a detected condition of the banknote deposit/withdrawal device 1, and informs the body control means 106 as to a condition of the banknote deposit/withdrawal device 106 whenever it is necessary. Within the banknote deposit/withdrawal device 1, it is connected to drive motors and sensors for various units (the deposit/withdrawal port 20, the banknote checking means 30, the temporary storage 40, the banknote transfer path 50, the deposit storage 60, the withdrawal storage 70, the recycle storage 80, and the charge/restore storage 81), and controls and drives actuators in accordance with transaction while it monitors conditions thereof by means of the sensors.

The banknote deposit/withdrawal device 1 comprises an upper transfer mechanism 1*a* which is composed of the deposit/withdrawal port 20, the banknote checking means 30, the temporary storage 40 and the banknote transfer path 50, and a lower banknote mechanism 1*b* which is composed of the deposit storage 60, the withdrawal storage 70, the recycle storage 80, and the charge/restore storage 81, and as well, a transfer path 90 which can be opened and closed and which laid along the front surfaces of these storages.

The lower banknote mechanism 1*b* is mounted in the safe housing 116 made of thick steel panels having a thickness of about 50 mm, and the transfer paths of the upper transfer mechanism 1*a* and the lower banknote mechanism 1*b* are connected with each other by a connection transfer path 501*h*.

The connection transfer path 501*h* is provided at a position where a transfer path 501*g* in the upper transfer mechanism 1*a* on the top surface steel panel of the safe housing 116 surrounding the lower banknote mechanism 1*b* is connected to a lower transfer path 901*a* in the lower banknote mechanism 1*b*. A slit formed in the top surface steel panel has a length by which banknotes can pass, and a size corresponding to a width of transfer rollers which are mounted so as to pinch and pay out banknotes which have been transferred up to the slit.

In the case of such a configuration that the lower banknote mechanism is not surrounded by the safe housing, the upper banknote transfer mechanism 1*a* is directly mounted on the lower banknote mechanism 1*b*, no connection transfer path 501*h* is always necessary.

The upper banknote transfer mechanism and the lower banknote mechanism may be provided with drive sources (motors) for their transfer paths, respectively, but they may be provided with a single drive source so as to transmit a power to their transfer paths by means of gears located among transfer paths 501*g*, 501*h*, 901*a*.

Figure 5:
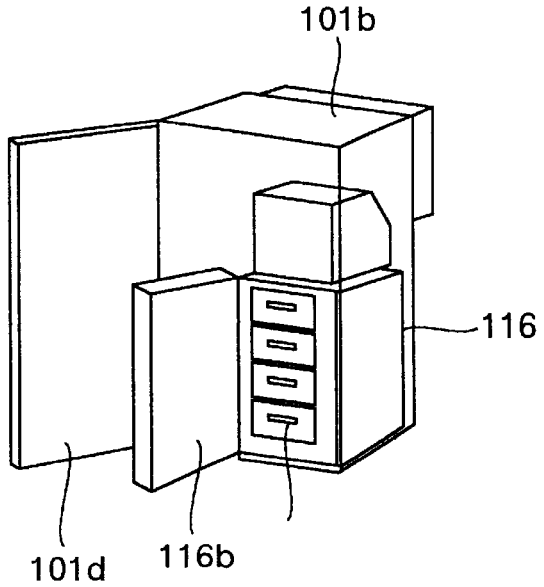
FIG. 5 is a perspective view illustrating an external appearance of the embodiment of the ATM according to the present invention, in which a rear door is opened.

Referring to FIG. 5 which is a perspective view illustrating the ATM as viewed from its rear side, with its rear door being opened, the rear door 101*d* of the ATM and a rear door 116*b* of the safe housing 116 can be opened and closed. As shown in this figure, when both doors 101*d* and 116*b* are opened, storages respectively attached thereto with handles are exposed. Thus, a person in charge can pull out each of the storages by gripping the handle thereof in order to handle them.

With this configuration, the replenishment and restoration of banknotes, removable of banknotes jamming upon occurrence of an abnormality or the like can be facilitated, that is, the manipulatablity can be enhanced.

It is noted that rails provided for the respective storages allow them to be smoothly pulled in and out.

The banknote transfer path 50 shown in FIG. 3 allows banknotes to pass through the banknote checking portion 30 in both directions, and is connected to the deposit/withdrawal port 20, the temporary storage 40, the deposit storage 60, the withdrawal storage 70, the recycle storage 80 and the charge/restore storage 81 by way of transfer paths indicated by arrows 501*a* to 501*h* and 901*a* to 901*d*.

Of these arrows, single head arrows indicate one-way banknote transfer paths for transferring banknotes in a direction indicated by the associated arrow, and double head arrows indicate two-way banknote transfer paths for transferring banknotes in either one of both directions, being switched in accordance with a kind of transaction.

In the banknote transfer path 50, five banknote paths 901*a* to 901*d* laid in front of the deposit storage 60, the withdrawal storage 70, the recycle storage 80 and the charge/restore storage 81 within the lower banknote mechanism 1*b*, constitute an openable and closable transfer path 90 in which the transfer paths can be opened and closed as a one-unit body.

Rain water falling onto the deposit/withdrawal port 20 is led into a drain channel 315, and is then drained outside of the ATM by way of a vertical drain channel 317.

Next, explanation will be made of an example of the configuration of the deposit/withdrawal port 20 formed in the banknote deposit/withdrawal device 1 with reference to FIGS. 6 to 11. The deposit/withdrawal port 20 is incorporated thereto with a rain water draining means by means of which rain water can be drained outside of the ATM without coming into the inside of the deposit/withdrawal port.

First, the configuration of the shutter 201 serving as a door for the deposit/withdrawal port 20 will be briefly explained.

Figure 6:
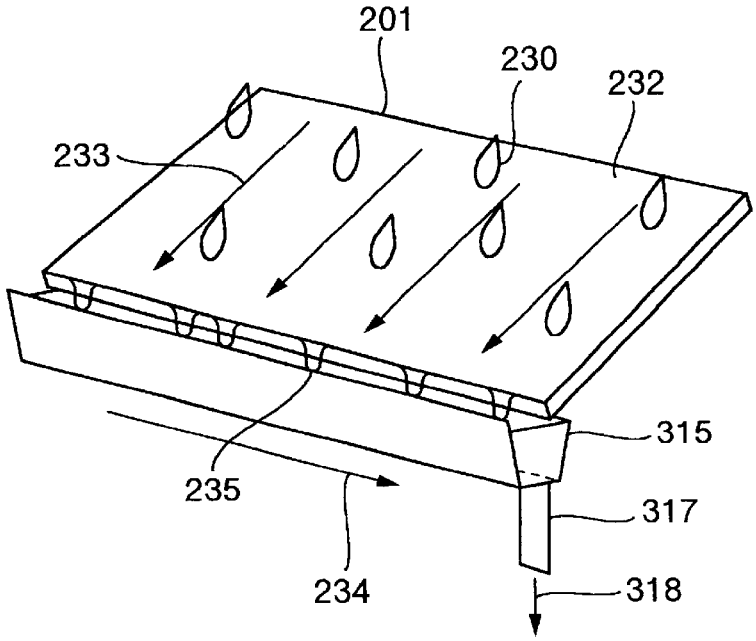
FIG. 6 is a perspective view illustrating an embodiment of a deposit/withdrawal port door in the embodiment of the ATM according to the present invention.

Referring to FIG. 6, a single inclined surface 232 formed on the outer surface of the shutter 201 is inclined only in one direction. Rain drops falling onto the shutter 201 flows in a direction indicated by the arrows 233 along the slope of the shutter surface. Rain water 235 dripping from the lower end of the shutter 201 is received in a drain channel 315 which is laid along the lower end of the shutter 201, being inclined downward in a direction indicated by the arrow 234, and is connected thereto at its lowermost end with a drain pipe 317 for discharging rain water received from the drain channel 315 in a direction indicated by the arrow 318.

Figure 7:
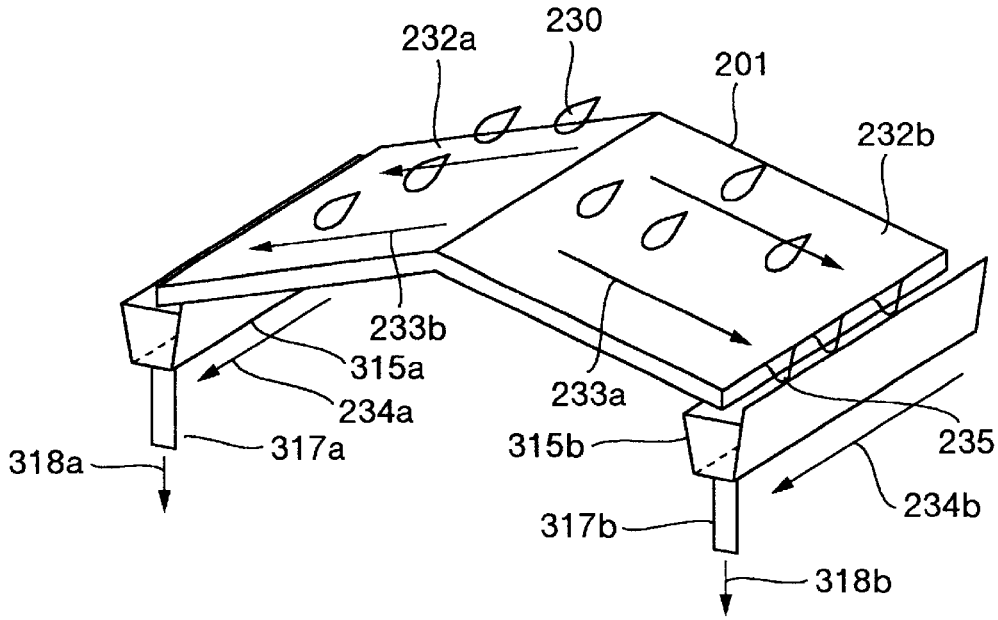
FIG. 7 is a perspective view illustrating another embodiment of the deposit/withdrawal port door in the ATM according to the present invention.

Referring to FIG. 7 which is a view illustrating a shutter incorporated with a plurality of inclined surfaces, rain drops 230 falling onto the shutter 201 flow in directions indicated respectively by the arrows 233*a*, 233*b* along slopes of the surface of the shutter. The shutter 201 is provided at its left and right sides with drain channels 315*a*, 315*b* which are adapted to receive rain water 235 dripping from the left and right sides of the shutter 201.

The drain channels 315*a*, 315*b* are inclined downward respectively in directions indicated by the arrows 233*a*, 233*b*, and are connected at their lowermost ends to drain pipes 317*a*, 317*b* through which the rain water received from the drain channels 315*a*, 315*b* is discharged as indicated by the arrows 318*a*, 318*b*.

With either of the above-mentioned configurations, rain water falling onto the upper surface of the shutter is led into the drain channels through which the rain water can be drained.

Next, explanation will be made of an example of the deposit/withdrawal port incorporating the single inclined surface 232 on the surface of the shutter 201 shown in FIG. 6, with reference to FIGS. 8 to 11.

Figure 8:
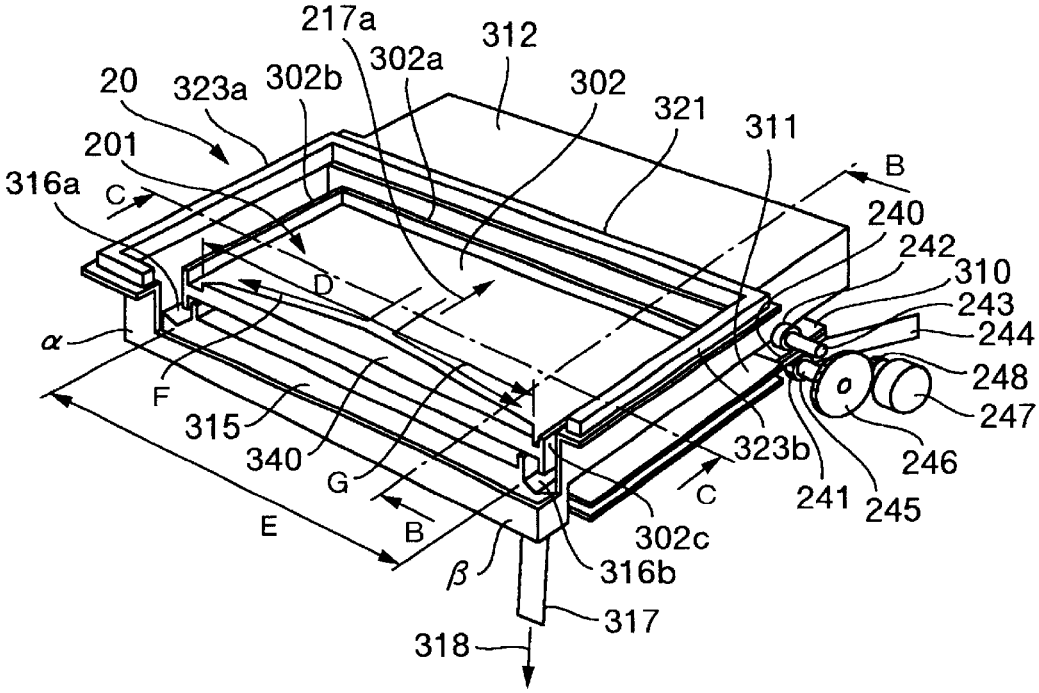
FIG. 8 is a perspective view illustrating a configuration of a deposit/withdrawal port in the ATM according to the present invention.

FIG. 8 is a view illustrating the shutter (deposit/withdrawal door) in a closed condition.

Figure 9:
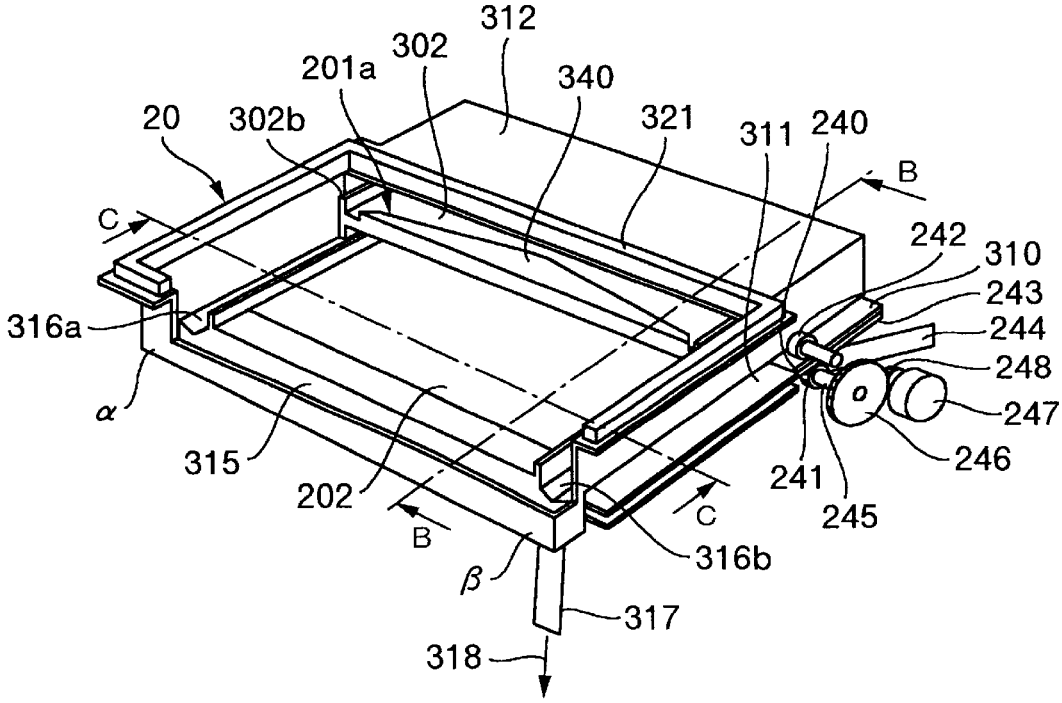
FIG. 9 is a perspective view illustrating another configuration of the deposit/withdrawal port in the ATM according to the present invention.

FIG. 9 is a view illustrating the shutter in an opened condition. The shutter 201 shown in FIG. 8, is opened being slid in a direction indicated by the arrow 217*a* so as to be shifted into an open condition indicated by 201*a*, and accordingly, the user can take banknotes for deposit or for withdrawal into and out from a banknote charge port 202.

Figure 10:
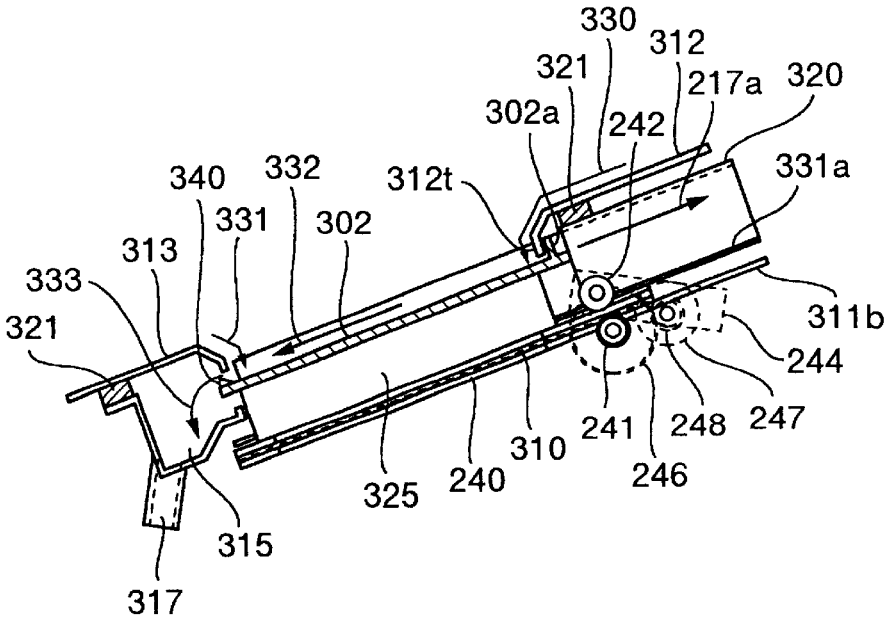
FIG. 10 is a sectional view illustrating the configuration of the deposit/withdrawal port in the ATM according to the present invention.

FIG. 10 is a sectional view along line B—B shown in FIGS. 8 and 9, illustrating the deposit/withdrawal port.

Figure 11:
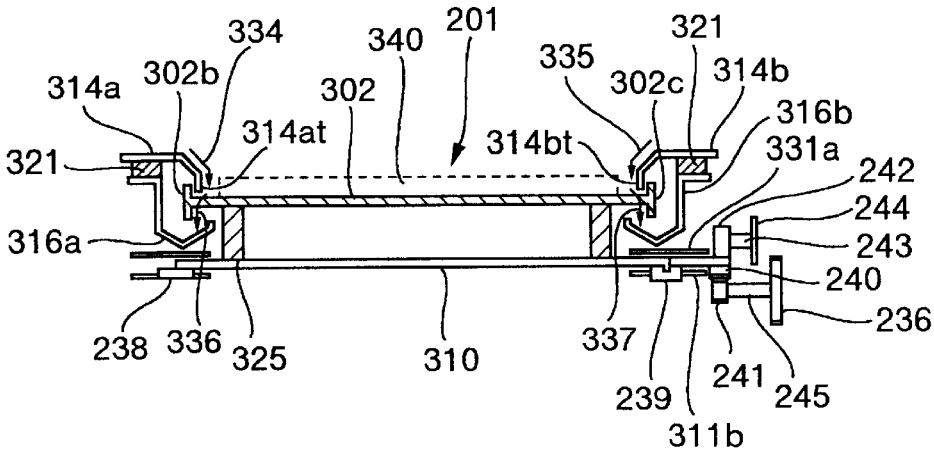
FIG. 11 is a sectional view illustrating another configuration of the deposit/withdrawal port in the ATM according to the present invention.

FIG. 11 is a sectional view along line C—C shown in FIGS. 8 and 9, illustrating the deposit/withdrawal port.

Referring to FIG. 10, a slide member 310 is supported so as to be movable between slide rails 311*a*, 311*b* in a direction indicated by the arrow 217*a* or 217*b*, and the shutter 201 is carried on the slide member 310. When the slide member 310 is moved in a direction of the arrow 217*a* or 217*b*, the shutter 201 opens the deposit/withdrawal port 202 so that the user can deposit and withdraw cash. A shutter cover 320 is provided so that the shutter 201 is accommodated in the shutter cover 320 when the shutter 201 is opened, as shown in FIG. 9.

Next, explanation will be made of an example of the configuration of a mechanism for opening and closing the shutter with reference to FIGS. 8 to 11.

Referring to FIGS. 8 to 11, the shutter 201 is supported by the slide member 310, having a shutter outer surface panel 302 which is attached to the slide member 310 by means of a support member 325 shown in FIGS. 10 and 11. One end of the slide member 310 is slidably fitted in a groove formed in a guide rail 239 shown in FIG. 11 and made of synthetic resin, so as to be movable in a direction indicated by the arrow 217*a* shown in FIG. 10. The other end of the slide member 310 is supported by a guide 238 made of synthetic resin as shown in FIG. 11. Since the slide member 310 is supported at its both ends by components made of synthetic resin having a low frictional coefficient, and accordingly, it can be smoothly moved in the direction of the arrow 217*a*.

Figure 12:
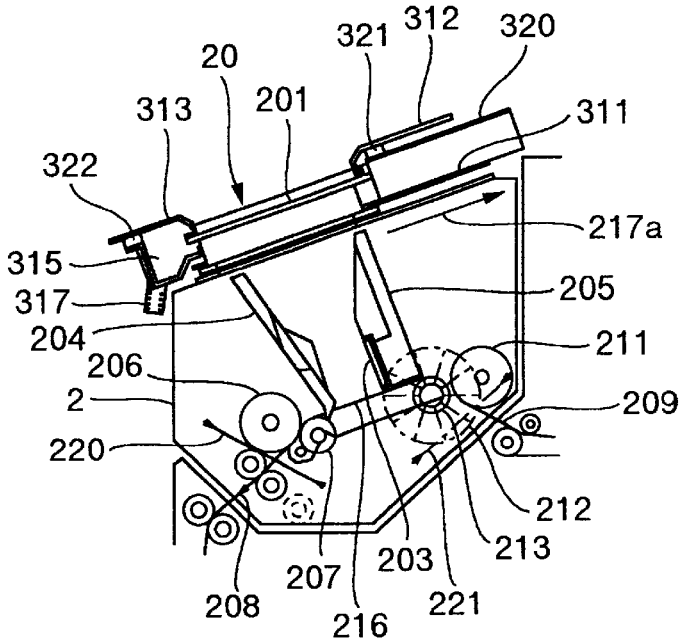
FIG. 12 is a side view illustrating the deposit/withdrawal port in an embodiment of the present invention (in an awaiting condition)

The slide member 310 is provided at its one end with a rack 240 shown in FIGS. 11 and 12, and accordingly, it is moved by a gear 241 through the intermediary of the rack 240 when the gear is rotated. A guide roller 242 is pressed against the slide member 310 on the side remote from the gear 241 in order to prevent the gear 241 and the rack 240 which are meshed with each other, from being disengaged from each other. The guide roller 242 is supported by a guide roller shaft 243 and a guide roller support plate 244 as shown in FIG. 11. The gear 241 is coupled to a reduction gear 246 through the intermediary of a shaft 245 shown in FIG. 11, and the reduction gear 246 is meshed with a pinion gear 248 connected to a motor 247 shown in FIG. 10.

The rotational speed of the motor 247 is reduced through the intermediary of the reduction gear 246, and then, the gear 241 is rotated so as to actuate the rack 240 in order to move the shutter 201 in the direction of the arrow 217*a*.

In order to open the shutter from the closed condition shown in FIG. 8, the motor 247 is rotated counterclockwise, and in order to close the shutter from the opened condition shown in FIG. 9, the motor 247 is rotated clockwise.

Explanation will be made of such a configuration that rain water falling onto the shutter in a rainy weather condition is drained outside of the ATM with reference to FIGS. 8 to 11. It is noted that a rain water cover which will be explained later is not shown in FIGS. 8 and 9.

A lower drain channel 315 has such a configuration as to receive rain water which flows therethrough, and is laid inclined so that a portion β thereof is lower than a portion α thereof as shown in FIGS. 8 and 9. Thus, the rain water flows from the portion α to the portion β. A vertical drain channel 317 is a pipe for draining rain water flowing into the lower drain channel 315, in a direction of the arrow 318.

The vertical drain channel 317 drains rain water outside of the ATM. Side drain channels 316*a*, 316*b* serving as sub-drain channels are laid on opposite sides of the outer surface panel 302 of the shutter, and are connected at their lower ends to the lower drain channel 315. Thus, rain water flowing through the side drain channels 316*a*, 316*b* merges into the lower drain channel 315.

It is noted that if the side drain channels has a V-like shape, that is, if their bottom surfaces have a wedge-like shape, the flow rate can be increased even though the quantity of rain water is less, thereby it is possible to offer such an advantage as to prevent sediment contained in rain water from being deposited.

Seal members 321 shown in FIG. 10 are made of flexible rubber, and are interposed, being pressed, between the shutter cover 320 and the rain water cover 312, between the lower drain channel 315 and the rain water cover 313, and between the side drain passages 316*a*, 316*b* and the rain water covers 314*a*, 314*b* in order to prevent rain water and the ambient air from coming into the inside of the ATM.

The lower end of the front end 312*t* of the rain water cover 312 which is laid upstream of the shutter 201 shown in FIG. 10, is located downstream of and below the upper ends of protrusions 302*b* which are positioned in or around the upstream end part of the shutter 201, and is telescopic in order to prevent rain water flowing in a direction of the arrow 330 or rain water falling onto the outer surface of the shutter 201 from coming into the inside of the ATM.

As shown in FIG. 11, the lower ends 314*at*, 314*bt* of the rain water cover 314*a*, 314*b* laid at opposite sides of the shutter are located inside of and below the upper ends of protrusions 302*b*, 302*c* located in or around the upstream end parts of the side surfaces of the shutter 201, and are telescopic in order to prevent rain water flowing in directions of the arrow 334 or 335 or rain water falling onto the outer surface of the shutter from coming into the inside of the ATM.

An air gap is defined between the rain water cover 313 and the shutter outer surface, downstream of the shutter outer surface panel 302 as shown in FIG. 10, through which rain water falling onto the shutter or rain water falling around the shutter and flowing on the shutter in a direction of the arrow 332 can pass.

A protrusion 340 (refer to FIGS. 8 and 9 as to its shape) is provided in the lower end part of the shutter surface panel 302 shown in FIG. 11. As an example, the protrusion 340 is substantially right-and-left symmetric, that is, the center part thereof is located most upstream, and becomes downstream toward its left and right side ends so as to define an inclined surface. The crosswise widths of the protrusion 340 is greater than the width E (shown in FIG. 8) of the inner side surfaces of the side drain channels 316*a*, 316*b*, but smaller than the width of the rain water covers 314*a*, 314*b*.

That is, in this example, the shutter surface panel 302 is inclined downward forward so as to obtain a first inclination, and is then inclined so that the left and right end parts thereof become downstream in order to obtain a second inclination, beyond the protrusion 340.

Thus, with the provision of the protrusion 340 in the lower end part of the outer surface of the shutter, rain water flowing on the outer surface of the shutter 302 flows along the boundary between the protrusion 310 and the outer surface of the shutter 302 as indicated by the arrows F to G shown in FIG. 8 whenever the rain water is bit, and then it flows toward the left and right end parts. The rain water flows into the lower drain channel 315 in the vicinity of the side drain channel 316*a* or 316*b* after flowing between the end part of the protrusion 340 and protrusion 302*b* or 302*c* provided in the end part of the shutter 302.

Further, even though the shutter 201 is moved in the direction of the arrow 217*a* so as to be opened in a condition in which rain water remains on the outer surface of the shutter 201 as shown in FIG. 10, the rain water flows in the direction indicated by the arrows F to G, and the rain water then flows into the side drain channels 316*a*, 316*b* since the width E of the protrusion 340 is greater than the inside size D of the side drain channels 316*a*, 316*b*, thereby it is possible to offer such an advantage as to prevent rain water from coming into the deposit/withdrawal port 202 which is opened.

That is, the protrusion 340 serves as a means for preventing rain water pooling on the outer surface of the shutter 201 from coming into the deposit/withdrawal port 202, when the shutter is operated so as to be opened or closed, and also serves as a rain water branching means for causing rain water to flow into the drain channels after the drain water is parted toward the left and right sides.

When the shutter 201 is closed, if the flow rate of rain water is high, the rain water flows over the protrusion 340 and into the lower drain channel 315, and is then drained outside of the ATM after it passes through the vertical drain channel 317.

With the configuration as mentioned above, there may be offered such an advantage that rain water falling onto the outer surface of the shutter or therearound, can be prevented from flowing into the inside of the ATM, and further, the rain water can be drained outside of the ATM.

Next, explanation will be made of the operation of the ATM provide with the deposit/withdrawal port incorporating the shutter as mentioned above.

Figure 13:
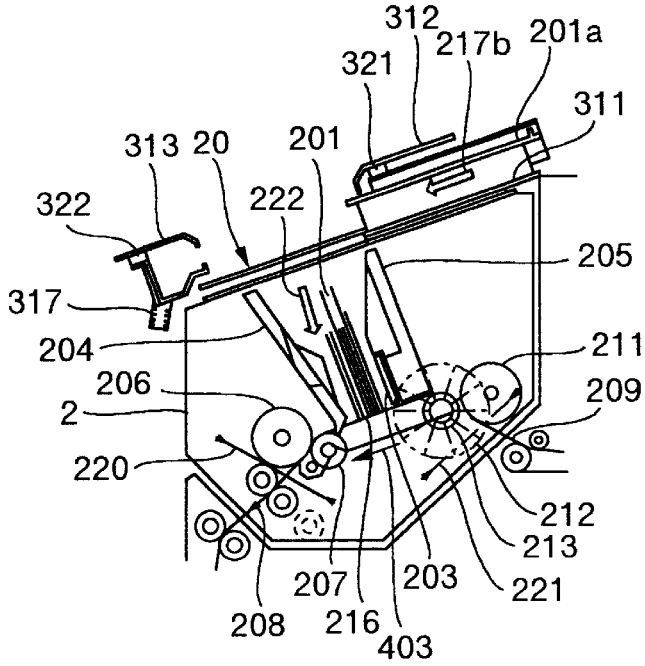
FIG. 13 is a side view illustrating the deposit/withdrawal port in an embodiment of the present invention (in a deposit condition)
Figure 14:
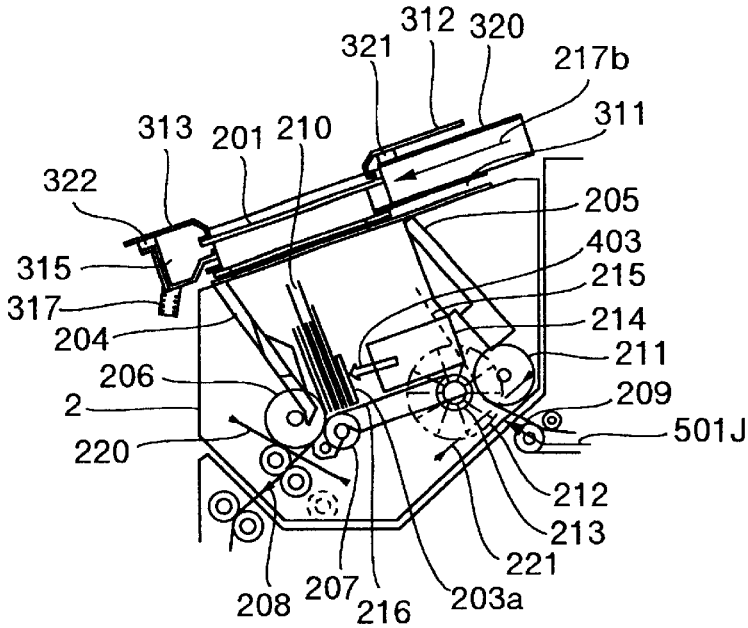
FIG. 14 is a side view illustrating the deposit/withdrawal port in the embodiment of the present invention (in a pay-out condition)

During deposit transaction, as shown in FIG. 8, when the user deposits his cash, the slide member 310 is operated so as to move the shutter 201 in the direction of the arrow 217*a* so as to be opened, and accordingly, the deposit/withdrawal port 20 is opened as shown in FIGS. 13 and 14 so that banknotes can be inserted among the front panel 204, the pusher panel 203 and the rear panel 205 in the direction of the arrow 225.

Next, as shown in FIG. 13, during operation paying out the deposited banknotes, the shutter 201 is moved in the direction of the arrow 217*b* so as to be closed, the banknotes are pressed in a direction toward the feed roller 205 or a direction of the arrow 403, by the pusher panel 203 so that the pusher panel 203 and the front panel 204 are located at positions indicated by 203*a*, 204*a*. Thus, the banknotes are fed through the rotation of the feed roller 206 while double feed of the banknotes is prevented by a gate roller 207 which is not rotated in the pay-out direction. Thus, the banknotes 210 in the deposit/withdrawal port 20 are paid out in the direction of the arrow 208, and merges into the banknote transfer path 50 so that they are led into the ATM.

Further, banknotes discharged from the ATM or banknotes rejected due to such a reason that they cannot be determined during deposit, are transferred in a direction of the arrow 501*j* in the ATM, as shown in FIG. 14, and are then fed between a stack roller 211 and a back-up roller 213 which are on rotation. A brush roller 212 is coaxial with the back-up roller 213 and is radially provided therearound with elastic members 212*a*, being driven by drive sources which are not shown, so as to be rotated independent from the back-up roller 213.

The banknotes fed into between the stack roller 211 and the back-up roller 213 make contact with the elastic members 212*a* of the brush roller 212 which is stopped, and then pass through between the brush roller 212 and the stack roller 214 by elastically deforming force of the elastic members 212*a* while they are applied thereto with a frictional resistance. The banknotes comes once to a stop at a position which is indicated by the broken line 215, and at which the pinching and transferring force by the stack roller 211 and the back-up roller 213 is lost. Just after, the brush roller 212 is rotated, and therefore, they are accumulated in a space between the pusher panel 202*a* and the rear panel 205*a*.

Figure 15:
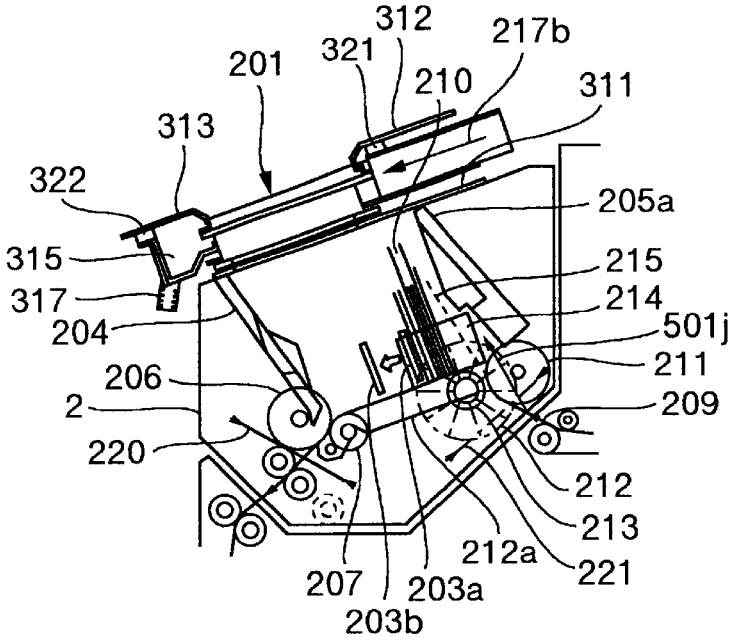
FIG. 15 is a side view illustrating the deposit/withdrawal port in the embodiment of the present invention (in a withdrawal condition)

As shown in FIG. 15, the position of the pusher panel 203*b* is displaced as the number of stacked banknotes is increased, and accordingly, the banknotes are stacked in order without jumping out upward in the storage space, by being horizontally scraped out by the brush roller 212, with less vertical misalignment and with no interference with banknotes which are continuously transferred.

Figure 16:
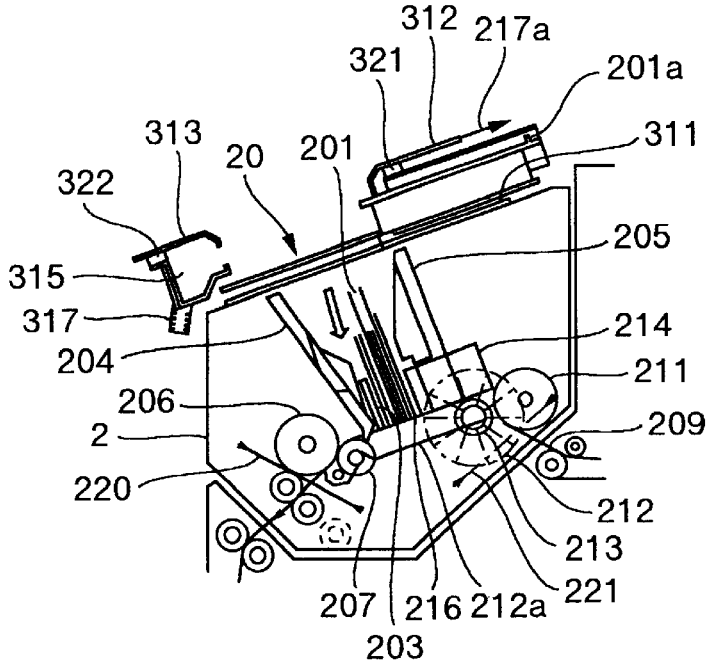
FIG. 16 is a side view illustrating the deposit/withdrawal port in the embodiment of the present invention (in a withdrawal with the shutter being opened).

As shown in FIG. 16, the stacked banknotes 210 are moved to a position where they are held between the rear panel 05 and the pusher panel 203, and the shutter is moved in the direction of the arrow 207*b* and is therefore opened to the position 201*a* where the preparation for taking out the banknotes has been completed. Thus, the user can take out the banknotes.

Next, referring to FIG. 3, the procedure of handling banknotes 210 in the banknote deposit/withdrawal device 1 will be explained.

The banknote checking portion 30 is composed of a double feed detecting part which is though not shown in detail, for detecting a displacement of a roller when a banknote is transferred between a pair of rollers so as to detect whether two overlapped banknotes are present or not, and a discriminating part for detecting a printing pattern or the like of a transferred banknote with the use of an image sensor or the like so as to detect a kind of the banknote and whether the banknote is authentic or not. The banknote checking portion reports to the control means 35 an information as to a result of the discrimination for each of banknotes passing therethrough.

The temporary storage 40 successively receives therein banknotes inserted through the deposit/withdrawal port 20 and confirmed by the banknote checking portion 30 as to their denominations during deposit transaction, and it retains once until the transaction is completed. After the completion of the transaction, the banknotes are paid out one by one from the temporary storage 50. In this embodiment, during withdrawal transaction, the temporary storage 50 stores rejected banknotes whose denominations cannot be confirmed by the banknote checking portion 30, and temporary retains them until the withdrawal operation is completed. After the completion of the withdrawal operation, the rejected banknotes are discharged from the temporary storage during operation for storing banknotes inhibited from being discharged.

It is noted that only one deposit storage 60 is provided in this embodiment.

Banknotes to be stored in this deposit storage, are diverged by a switching gate which is not shown, from the banknote transfer path (a direction of the arrow 901*a*) and is transferred in a direction of the arrow 902*a*, and are then stacked in the deposit storage 60 into which banknotes are successively transferred without interfering with one another.

Only one withdrawal storage 70 is provided in this embodiment, and banknotes to be withdrawn are set therein in order by a person in charge, and are then paid out one by one in a direction of the arrow 902*e* on the banknote transfer path.

Only one recycle storage 80 is provided in this embodiment, having both functions of successively storing banknotes, similar to the deposit storage 60 and separating banknotes one by one and successively paying out them, similar to the withdrawal storage 70, that is, it can carry out storing, separation and pay-out of banknotes.

The charge/restore storage 81 has the same configuration as that of the recycle storage 80, which may be used as the recycle storage although it is not used during transaction for deposit and withdrawal, as will be explained later.

Next, referring again to FIG. 3, explanation will be made of the operation of the banknote deposit/withdrawal means in this embodiment.

During deposit transaction, there are carried out two main operations, that is, deposit counting operation for counting banknotes which are deposited by the user, and deposit storing operation for sorting them for denominations and storing them for every denomination after the user agrees the counted amount and inputs "Confirmation". If the user selects "Cancellation" for interrupting the deposit transaction, operation of cancellation is carried out.

During operation for counting deposited money, banknotes charged in the deposit/withdrawal port 20 are separated one by one, and are then led in directions indicated by the arrows 501*a*, 501*b*, and they are determined as to their denominations and whether they are authentic or not by means of the banknote checking portion 30. The banknotes are diverged by changing over switching gates which are not shown, and are transferred in directions of the arrow 501*c* and 501*d* after they can be determined, in order to be once stored in the temporary storage 40. Banknotes which cannot be determined by the banknote checking portion 30 or banknotes which are rejected from being deposited since their inclinations or intervals thereof are abnormal are led in a direction of the arrow 501*g* by changing over the switching gates, without being stored in the temporary storage 40, and are charged in the deposit/withdrawal port 20 for returning them to the user.

During deposit storing operation, a rotary drum 401 in the temporary storage 40 is rotated in a direction reverse to that during the storing operation, and banknotes wound up thereon are fed in a direction of the arrow 501*d* reverse to that during the storing operation, in the order reverse to that during the storing operation, and are then further fed as indicated by the arrows 501*c*, 501*b*. Thus, they pass through the banknote checking portion 30, and by changing switching gates which are not shown, they pass as indicated by the arrows 501*g*, 501*h*, 901*a*. Thereafter, they are stored into the designated one of the deposit storage 60, the recycle storage 80 and the reject storage 70 by changing over switching gates which are not shown and which are provided for the deposit storage 60, the recycle storage 80 and the reject storage 70. At this stage, although the banknotes may be checked again as to their denominations and authenticity by means of the banknote checking portion 30 in order to designate a storage, the designation may be made in accordance data from a means provided for storing therein all results of determination for the banknotes which have been stored in the temporary storage during deposit counting. In the latter case, the processing time for designating a storage can be shortened well, and further, parts of the banknote transfer path which are indicated by the arrows 501*g*, 501*g*, 901*a* can be eliminated.

If the user selects "Cancellation" in order to carry out cancellation and returning, the rotary drum 401 of the temporary storage 40 is rotated in the direction reverse to that during the storing operation while switching gates which are not shown are changed over, and accordingly, banknotes wound up thereon are transferred in the order to reverse to that during the storing operation, as indicated by the arrows 501*e*, 501*f*. Thus, the banknotes are stored in the deposit/withdrawal port 20 so as to be returned to the user.

During withdrawal transaction, banknotes are paid out by predetermined numbers from storages including the deposit storage 70 and the recycle storage 80 for different denominations, and are transferred, as indicated by the arrows 901*e*, 901*d*, 901*c*, 901*b*, 901*a*, 501*h*, 501*g*, to the banknote checking portion 30 where their banknotes are checked. Then, the banknotes are transferred as indicated by the arrows 501*c*, 501*f*, and are then stored in the deposit/withdrawal port 20 from which they are delivered to the user. If withdrawal rejection occurs in the banknote checking portion 30, that is, a banknote which cannot be determined in the banknote checking portion 30 is present, the banknote is once stored in the temporary storage 40 after being transferred as indicated by the arrows 501*c*, 501*d*, similar to the deposit counting, by changing over switching gates which are not shown. In sufficient banknotes are replenished with those paid out from the deposit storage 70 or the recycle storage 80.

If rejection occurs during withdrawal transaction so that a rejected banknote is stored in the temporary storage 40, operation for withdrawal rejection is carried out. In this embodiment, banknotes rejected from being withdrawn, are transferred from the temporary storage 40 and are all stored in the deposit storage 60. Alternately, they may be again determined as to their denominations and whether they are authentic or not, and accordingly, banknotes which can be determined, having denominations with which they can be stored in the recycle storage 80 may be stored in the latter. With this configuration, the number of rejected banknotes can be reduced, thereby it is possible to enhance the efficiency of fund operation.

With the provision of the deposit/withdrawal port and the shutter incorporating the above-mentioned configuration, it is possible to effect such advantages as to prevent rain water falling onto the outer surface of the shutter or around thereof from flowing into the inside of the ATM, and to drain the rain water outside of the ATM.

According to the present invention, the shutter for the deposit/withdrawal port can be operated stable even in a rainy weather atmosphere, thereby it possible to provide a banknote handling device embedded in an outer wall, having a deposit/withdrawal port which is exposed to the ambient air.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A banknote handling device including:

a door having an outer surface exposed outdoors, for covering a deposit/withdrawal port for banknotes; and a rain water draining means for draining rain water falling on the outer surface of the door, outside of the banknote handling device, the rain water draining means comprising:

an inclined surface provided on the outer surface of the door;

a water channel for allowing rain water dripped from the outer surface of the door to flow therethrough, and a water pipe for receiving the rain water from the water channel and for draining the rain water outside of the banknote handling device.

2. A banknote handling device as set forth in claim 1, wherein the water channel comprises:

left and right sub-channels laid substantially in parallel with left and right edges of the door, for receiving rain water dripping from the left and right edges thereof, and allowing the rain water to flow forward; and a main water channel laid substantially in parallel with a front edge of the door, for receiving rain water dripping from the front edge thereof, and for receiving the rain water flowing from the left and right sub-channels, the main water having left and right ends at least one of which is connected to a drain pipe, and being inclined so that the side where the one end is connected to the drain pipe is lower than the other side.

3. A banknote handling device as set forth in claim 1, wherein the outer surface of the door incorporates a plurality of inclined surfaces, and said water channels are laid along most downstream sides of the inclined surfaces, respectively.

4. A banknote handling device as set forth in claim 3, of the plurality of inclined surfaces, one is inclined downward forward of the device.

5. A banknote handling device as set forth in claim 3, wherein the outer surface of the door has a plurality of inclinations including a first inclination downward forward of the device, and a second inclination such that the inclined surface is highest at its center, and is lowest at its left and right ends.

6. A banknote handling device as set forth in claim 5, wherein a protrusion is provided around the forward lower end of the door, the protrusion being arranged so that its center part is located upstream of the first inclination and it becomes downstream of the first inclination toward the left and right ends of thereof.

7. A banknote handling device as set forth in claim 4, further comprising a rain water diverging means for diverging rain water accumulated on the door to both left and right ends of the door so that the rain water thereafter flows into the water channel when the door is shifted from its closed condition to its open condition.

8. A banknote handling device as set forth in claim 7, wherein the rain water diverging means is a protrusion provided around the lower end of the door inclined downward forward, the protrusion having its center located downstream of the inclination of the door, and becoming downstream of the inclination of the door toward its left and right end parts.

9. A banknote handling device including a door having an outer surface exposed outdoors, and being substantially horizontal but downward forward, for opening and closing a deposit/withdrawal port, comprising:

sub-water channels laid substantially in parallel with left and right edges of the door, and downward forward, and a main water channel laid substantially in parallel with a forward edge of the door, having left and right ends either one of which is connected to a water drain pipe, the main water channel being laid so as to be inclined in such a way that the side where the main water channel is connected to the drain pipe is lower than the other side thereof.

10. A banknote handling device having a door having an outer surface exposed outdoors and laid, substantially horizontal , being inclined downward forward, for opening and closing a deposit/withdrawal port for banknotes, comprising:

sub-water channels laid substantially in parallel with left and right edges of the door, and for receiving rain water dripping from the left and right edges thereof, and for causing the rain water to flow forward; and a main water channel laid substantially in parallel with a forward edge of the door, and having left and right ends at least one of which is connected to a drain pipe, for receiving rain water dripping from this forward edge, and for receiving rain water flowing from the left and right sub-water channels, the main drain channel being laid so as to be inclined in such a way that the side where the main water channel is connected to the drain pipe is lower than the other side thereof.

* * * * *